US005635290A

United States Patent [19]

Stopper et al.

[11] Patent Number: 5,635,290

[45] Date of Patent: Jun. 3, 1997

[54] KNIT LIKE NONWOVEN FABRIC COMPOSITE

[75] Inventors: Steven R. Stopper, Doraville; Susan C. Paul, Alpharetta; Jon E. Tinsley, Roswell, all of Ga.

[73] Assignee: Kimberly-Clark Corporation, Neenah, Wis.

[21] Appl. No.: 277,455

[22] Filed: Jul. 18, 1994

[51] Int. Cl.[6] ..... B32B 27/14; B32B 3/02; B32B 7/02; D04H 1/04

[52] U.S. Cl. ..... 428/198; 428/157; 428/212; 428/220; 428/373; 442/35; 442/183; 442/329; 442/353; 442/361; 442/382; 442/394

[58] Field of Search ..... 428/157, 212, 428/220, 286, 296, 300, 198, 373

[56] References Cited

U.S. PATENT DOCUMENTS

| | | | |
|---|---|---|---|
| 3,494,821 | 2/1970 | Evans | 161/169 |
| 3,692,618 | 9/1972 | Dorschner et al. | 161/72 |
| 3,783,072 | 1/1974 | Korpman | 156/244 |
| 3,849,241 | 11/1974 | Butin et al. | 161/169 |
| 4,041,203 | 8/1977 | Brock et al. | 428/157 |
| 4,340,563 | 7/1982 | Appel et al. | 264/518 |
| 4,443,513 | 4/1984 | Meitner et al. | 422/195 |
| 4,486,485 | 12/1984 | Sookne | 428/198 |
| 4,652,487 | 3/1987 | Morman | 428/138 |
| 4,653,492 | 3/1987 | Parsons | 128/155 |
| 4,657,802 | 4/1987 | Morman | 428/152 |
| 4,663,220 | 5/1987 | Wisneski et al. | 428/221 |
| 4,720,415 | 1/1988 | Vander Wielen et al. | 428/152 |
| 4,775,579 | 10/1988 | Hagy et al. | 428/284 |
| 4,789,699 | 12/1988 | Kieffer et al. | 524/271 |
| 4,842,596 | 6/1989 | Kielpikowski et al. | 604/385.2 |
| 4,879,170 | 11/1989 | Radwanski et al. | 428/233 |
| 4,935,287 | 6/1990 | Johnson et al. | 428/198 |
| 4,940,464 | 7/1990 | Van Gompel et al. | 604/396 |
| 5,192,606 | 3/1993 | Proxmire et al. | 428/284 |
| 5,230,701 | 7/1993 | Meyer et al. | 602/76 |
| 5,232,777 | 8/1993 | Sipinen et al. | 428/364 |
| 5,288,791 | 2/1994 | Collier, IV et al. | 524/505 |

FOREIGN PATENT DOCUMENTS

| | | |
|---|---|---|
| 0341875B1 | 11/1993 | European Pat. Off. . |
| 0586924 | 3/1994 | European Pat. Off. . |
| 92/16371 | 10/1992 | WIPO . |

*Primary Examiner*—Thurman K. Page
*Assistant Examiner*—Kathryne E. Shelborne
*Attorney, Agent, or Firm*—William D. Herrick

[57] ABSTRACT

The present invention provides a natural fiber knit-like multi-layer composite containing at least one layer of a nonwoven fiber web and at least one layer of an elastomeric material, wherein the nonwoven web layer is joined to the elastic layer at spaced-apart locations and is gathered between said spaced-apart locations. The nonwoven fiber web is fabricated from multicomponent conjugate fibers or filaments that contain at least one polyolefin, and is a spunbond fiber web, staple fiber web or hydroentangled web. The composite exhibits soft, cloth-like texture of natural fiber knits as well as highly useful elastic properties.

19 Claims, 2 Drawing Sheets

KNIT LIKE NONWOVEN FABRIC COMPOSITE

The present invention relates to a nonwoven fabric composite having a soft, cloth-like texture. More particularly, the present invention relates to a multi-layer composite containing a polyolefin nonwoven fabric that provides knit-like texture and hand.

The cloth-like hand of natural fiber fabrics is difficult to define by objective, quantitative criteria and, in general, is defined in terms of sensory perceptions. Consequently, a tactile evaluation of a fabric is usually accomplished by the sensory assessment of a panel of individuals. Some of the descriptive attributes usually associated with describing cloth-like fabrics, especially soft cloth-like fabrics, e.g., cotton fabrics, include softness, fuzziness, fullness and warmth.

There have been many attempts to produce nonwoven fabrics of synthetic fibers exhibiting cloth-like hand and other desirable physical properties. However, it is highly difficult to design and impart cloth-like textural properties into nonwoven fabrics made from synthetic fibers since textural properties of synthetic fibers are highly different from those of natural fibers. In addition, the need to combine desirable physical properties, including tensile strength and abrasion resistance, with the textural properties further complicates the task of producing synthetic fiber nonwoven fabrics having a cloth-like hand. Additional difficulties are encountered when it is attempted to produce cloth-like nonwoven fabrics having a knit-like elasticity in that non-elastomeric synthetic fiber webs do not provide the stretch and recovery characteristics of knit fabrics, and elastomeric synthetic fiber webs exhibit unpleasant rubbery and tacky textural properties. A knit fabric, as known in the art, indicates a fabric formed by interlooping one or more sets of yarns, which has stretch and recovery properties and traditionally has been used as a standard construction for certain apparel, e.g., underwear and hosiery.

It would be highly desirable to provide knit-like elastic nonwoven fabrics having a natural fiber cloth-like texture that are highly useful for producing disposable articles, e.g., diapers, incontinence products, sanitary napkins, hospital-care garments, training pants and the like.

SUMMARY OF THE INVENTION

There is provided a natural fiber knit-like nonwoven fabric composite containing at least one nonwoven fiber web layer and at least one elastic layer of an elastomeric material, wherein the nonwoven web layer is joined to the elastic layer at spaced-apart locations and is gathered between the spaced-apart locations. The nonwoven fiber web is fabricated from multicomponent conjugate fibers or filaments that contain a first polyolefin component and at least one additional polymer component. Desirably, the nonwoven web is a spunbond fiber web, bonded carded staple fiber web or a hydroentangled web. In accordance with the present invention, the nonwoven web has a cup crush energy equal to or less than about 200 g-mm and a cup crush peak load equal to or less than about 20 g. The elastic layer is, for example, in the form of a film, meltblown fiber web, spunbond fiber web, scrim, woven web, thin planar layout of strips or filaments, or the like, and suitable elastomeric materials for the elastic layer include elastomers of styrenic block copolymers, thermoplastic polyurethanes, thermoplastic copolyesters, thermoplastic polyamides, isoprene and blends thereof.

The present nonwoven web composite exhibits natural fiber knit-like, more specifically, cotton knit-like, texture and hand while providing highly useful elastic properties and physical strength. The knit-like composite is highly useful for elastic outer-covers and side-panels of various articles, such as, training pants, diapers, incontinence products, environmental and hospital protective garments, and surgical drapes.

The cup crush test measurements, which evaluate stiffness of a fabric, are determined on a 9"×9" square fabric which is placed over the top of a cylinder having approximately 5.7 cm in diameter and 6.7 cm in length, and fashioning the fabric into an inverted cup shape by sliding a hollow cylinder having an inside diameter of about 6.4 cm over the fabric covering the cylinder. The inside cylinder is then removed, and the top flat portion of the unsupported, inverted cup-shaped fabric contained in the hollow cylinder is placed under a 4.5 cm diameter hemispherically shaped foot. The foot and the cup shaped-fabric are aligned to avoid contact between the wall of the hollow cylinder and the foot which might affect the load. The peak load, which is the maximum load required while crushing the cup-shaped fabric test specimen, and the cup crush energy, which can be expressed as $$\sum_{i=0}^{\text{Peak load}} (\text{load})_i * (\text{distance traveled by the foot})_i,$$

are measured while the foot descends at a rate of about 0.25 inches per second (15 inches per minute) utilizing a Model FTD-G-500 load cell (500 gram range), which is available from the Schaevitz Company, Tennsauken, N.J.

The term "multicomponent conjugate fibers" refers to fibers and filaments containing at least two polymeric components which are arranged to occupy distinct sections in substantially the entire length of the fibers. The conjugate fibers are formed by simultaneously extruding at least two molten polymeric component compositions as a plurality of unitary multicomponent filaments or fibers from a plurality of capillaries of a spinneret. The term "spunbond fiber web" refers to a nonwoven fiber web of small diameter filaments that are formed by extruding a molten thermoplastic polymer as filaments from a plurality of capillaries of a spinneret. The extruded filaments are partially cooled and then rapidly drawn by an eductive or other well-known drawing mechanism. The drawn filaments are deposited or laid onto a forming surface in a random, isotropic manner to form a loosely entangled fiber web, and then the laid fiber web is subjected to a bonding process to impart physical integrity and dimensional stability. Bonding processes suitable for spunbond fiber webs are well known in the art, which include calender bonding, ultrasonic bonding and through air bonding processes. The production of spunbond webs is disclosed, for example, in U.S. Pat. No. 4,340,563 to Appel et al. and U.S. Pat. No. 3,692,618 to Dorschner et al. Typically, spunbond fibers have an average diameter in excess of 10 μm and up to about 55 μm or higher, although finer spunbond fibers can be produced. The term "bonded carded staple fiber web" refers to a nonwoven web that is formed from staple fibers. Staple fibers are produced with a conventional staple fiber forming process, which typically is similar to the spunbond fiber forming process, and then cut to a staple length. The staple fibers are subsequently carded and thermally bonded to form a nonwoven web. The term "hydroentangled web" refers to a mechanically entangled nonwoven web of continuous fibers or staple fibers in which the fibers are mechanically entangled through the use of high velocity jets or curtains of water. Hydroentangled webs are well known in the art, and, for example, disclosed in U.S.

Pat. No. 3,494,821 to Evans. The term "meltblown fibers" indicates fibers formed by extruding a molten thermoplastic polymer through a plurality of fine, usually circular, die capillaries as molten threads or filaments into a high velocity gas stream which attenuates the filaments of molten thermoplastic polymer to reduce their diameter. In general, meltblown fibers have an average fiber diameter of up to about 10 microns. After the fibers are formed, they are carried by the high velocity gas stream and are deposited on a collecting surface to form a web of randomly disbursed meltblown fibers. Such a process is disclosed, for example, in U.S. Pat. No. 3,849,241 to Butin. The term "elastic" or "elastic material" as used herein refers to a material or composite which can be elongated in at least one direction by at least 50% of its relaxed length, i.e., elongated to at least 150% of its relaxed length, and which will recover upon release of the applied tension at least 40% of its elongation. Accordingly, upon release of the applied tension at 50% elongation, the material or composite contracts to a relaxed length of not more than 130% of its original length.

DETAILED DESCRIPTION OF THE INVENTION

Figure 1:
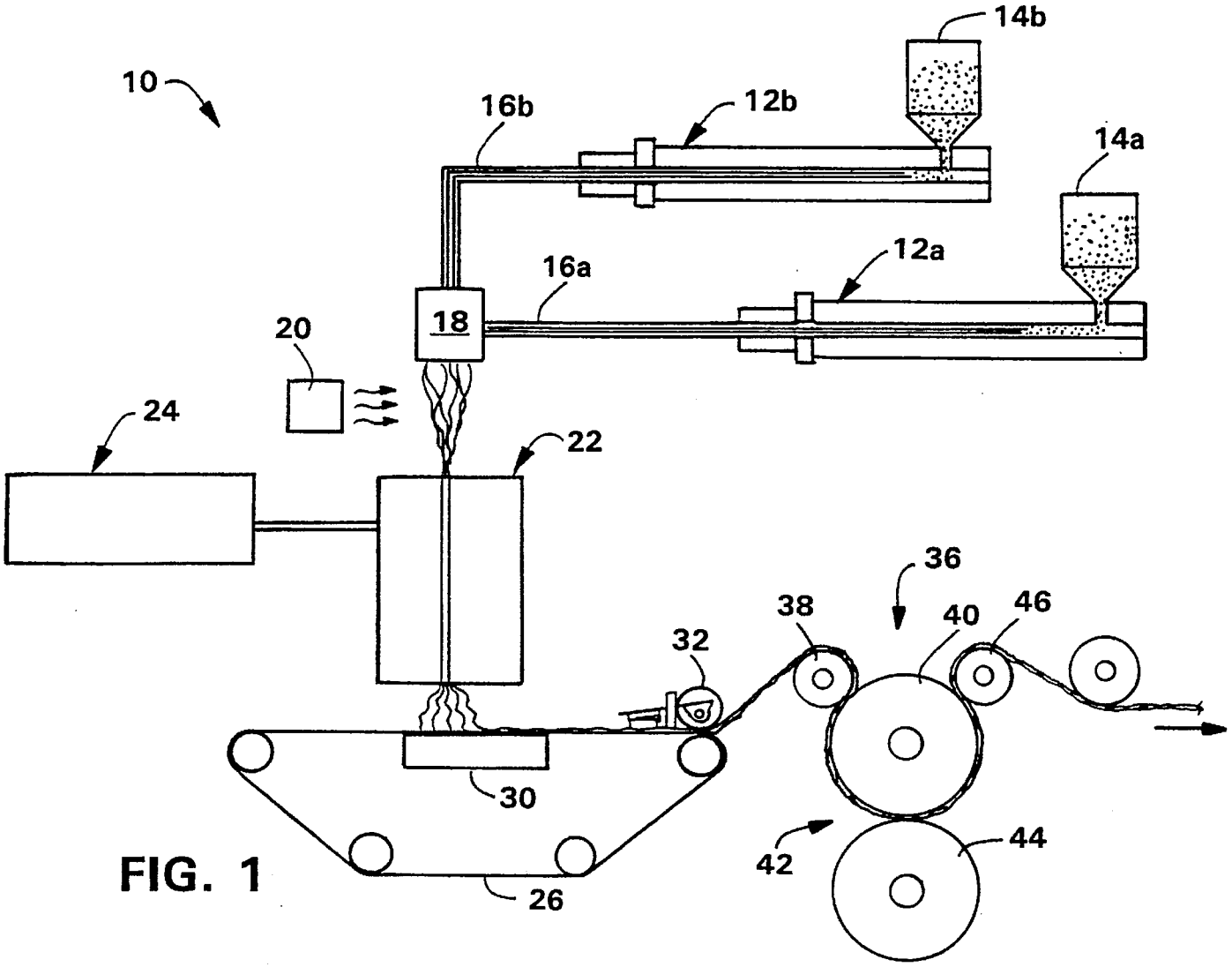
FIG. 1 illustrates a highly suitable process for producing the nonwoven web of multicomponent, more specifically bicomponent, conjugate fibers.

The present invention provides a natural fiber knit-like, e.g., a cotton knit-like, nonwoven composite which provides soft, cloth-like textural properties as well as desirable elastic stretch and recovery properties. The natural fiber knit-like composite is a laminate of at least one layer of a nonwoven fiber web and at least one layer of an elastic material. The nonwoven fiber web layer is produced from multicomponent conjugate fibers, desirably crimped conjugate fibers, containing at least one polyolefin, and suitable conjugate fibers have a side-by-side, island-in-sea or sheath-core, e.g., eccentric or concentric, configuration. Of the suitable conjugate fiber configurations, side-by-side and eccentric configurations are more highly suitable since conjugate fibers having these configurations are more amenable to thermal as well as mechanical crimping processes.

The nonwoven web layer of the composite contains gathers and is bonded to an elastic layer at a plurality of spaced-apart locations in a repeating pattern so that the composite can be stretched by extending or flattening the gathers of the nonwoven layer. Desirably, the present composite is formed by bonding an appropriate nonwoven web layer onto a tensioned elastic layer at a plurality of spaced-apart locations in a repeating pattern so that the nonwoven layer of the bonded composite is gathered between the bonded locations when the tension is released. The present knit-like composite exhibits highly pleasing aesthetic and tactile properties and thus is highly useful for disposable articles, e.g., diapers, sanitary napkins, incontinence products, training pants, disposable protective garments and surgical drapes. The knit-like composite, having a soft and cloth-like texture that minimizes skin irritation, is especially useful for articles that come in contact with the skin of the user. For example, the knit-like composite having desirable elasticity and texture is well suited for the waist band and leg cuffs of diapers, training pants and the like.

Nonwoven webs suitable for the present fabric composite include spunbond fiber webs, bonded carded staple fiber webs and hydroentangled webs of continuous and/or staple fibers that are produced from conjugate fibers having an average weight per unit length of from about 1 denier to about 5 denier, desirably from about 1.5 denier to about 3 denier. Suitable nonwoven webs are gatherable and have a basis weight between about 0.3 ounce per square yard (osy) and about 1 osy, desirably between about 0.4 osy and about 0.7 osy. Desirably, suitable nonwoven webs have a cup crush energy between about 30 g-mm and about 200 g-mm, more desirably equal to or less about 100 g-mm, most desirably equal to or less than about 50 g-mm, and a cup crush peak load between about 2 g and about 20 g, more desirably equal to or less than about 10 g, most desirably equal to or less than about 5 g.

Suitable conjugate fibers for the nonwoven webs of the present invention may have varying levels of crimps, and the conjugate fibers desirably have an average crimp level of up to about 20 crimps per extended inch, more desirably from about 3 to about 15 crimps per extended inch, as measured in accordance with ASTM D-3937-82. As is known in the art, crimps on thermoplastic fibers can be imparted mechanically or thermally, depending on the composition of the fibers and the types of crimps desired. Briefly, staple fibers can be crimped by passing fully formed filaments through a mechanical crimping device, e.g., a stuffer box or gear crimper, or a mechanical drawing or stretching process before the filaments are cut to staple lengths, and conjugate spunbond filaments containing two or more component polymers of different crystallization and/or solidification properties can be crimped by subjecting the filaments to an appropriate heat treatment, i.e., a thermal crimping process, during or after the drawing step of the spunbond fiber spinning process. When component polymers having different crystallization and/or solidification properties are formed into a unitary conjugate fiber, the difference in the polymer properties produces strain at the interface of the polymer components as the fiber is exposed to a heat treatment, which causes the fiber to crimp. Of the suitable crimping processes, more desirable are thermal crimping processes since they are simpler and more flexible in adjusting and varying the level of crimps in the filament than mechanical processes.

In accordance with the present invention, the component polymer compositions of the conjugate fibers are selected to have different melting points and/or different thermal shrinkage and crystallization properties. Conjugate fibers having polymer components of different melting points can be bonded by thermally softening or melting the lower melting component polymer of the fibers while allowing the higher melting component polymer to maintain the physical integrity and dimensional stability of the fibers. The softened or melted component of the conjugate fibers forms interfiber bonds throughout the web, uniformly effecting strong interfiber bonds without compacting and thus preserving the soft, cloth-like texture of the fiber web. Desirably, the melting point of the lowest melting component polymer of the fibers is at least about 5° C., more desirably at least about 10° C., lower than that of the other component polymers. Additionally, the component polymers can be selected to have different thermal shrinkage and crystallization properties to facilitate the formation of crimps on the conjugate fibers, as described above.

Polyolefins suitable for the present conjugate fibers include polyethylenes, e.g., high density polyethylene, medium density polyethylene, low density polyethylene and linear low density polyethylene; polypropylenes, e.g., isotactic polypropylene and syndiotactic polypropylene;

polybutylenes, e.g., poly(1-butene) and poly(2-butene); polypentenes, e.g., poly(2-pentene), and poly(4-methyl-1-pentene); polyvinyl acetate; and copolymers thereof, e.g., ethylene-propylene copolymer; as well as blends thereof. Of these, more desirable polyolefins are polypropylenes, polyethylenes, and blends and copolymers thereof; more particularly, isotactic polypropylene, syndiotactic polypropylene, high density polyethylene, and linear low density polyethylene. Other polymers suitable for the non-polyolefin components of the conjugate fibers include polyamides, polyesters and blends and copolymers thereof, as well as copolymers containing acrylic monomers. Suitable polyamides include nylon 6, nylon 6/6, nylon 10, nylon 4/6, nylon 10/10, nylon 12, and hydrophilic polyamide copolymers such as copolymers of caprolactam and an alkylene oxide, e.g., ethylene oxide, and copolymers of hexamethylene adipamide and an alkylene oxide, as well as blends and copolymers thereof. Suitable polyesters include polyethylene terephthalate, polybutylene terephthalate, polycyclohexylenedimethylene terephthalate, and blends and copolymers thereof. Acrylic copolymers suitable for the present invention include ethylene acrylic acid, ethylene methacrylic acid, ethylene methylacrylate, ethylene ethylacrylate, ethylene butylacrylate and blends thereof. Among various combinations of the above-illustrated suitable component polymers, particularly suitable conjugate fibers contain a combination of different polyolefins and more particularly suitable conjugate fibers contain a polyethylene, e.g., high density polyethylene, linear low density polyethylene and blends thereof, and a polypropylene, e.g., isotactic propylene, syndiotactic propylene and blends thereof. It is to be noted that conjugate fibers containing combinations of polyethylenes alone may not be particularly desirable in that nonwoven webs produced from these conjugate fibers provide low levels of tensile strength and abrasion resistance, similar to polyethylene monocomponent fiber webs.

The polymer component compositions for the conjugate fibers may further include minor amounts of an acrylic copolymer to enhance the soft texture of the fibers and thus the fiber webs. Useful acrylic copolymers for the present invention include ethylene acrylic acid, ethylene methacrylic acid, ethylene methylacrylate, ethylene ethylacrylate, ethylene butylacrylate and the like, as well as blends thereof. The fiber compositions may additionally contain minor amounts of compatibilizing agents, abrasion resistance enhancing agents, crimp inducing agents, various stabilizers, pigments and the like. Illustrative examples of such agents include acrylic polymer, e.g., ethylene alkyl acrylate copolymers; polyvinyl acetate; ethylene vinyl acetate; polyvinyl alcohol; ethylene vinyl alcohol and the like.

A highly suitable process for producing suitable nonwoven conjugate fiber webs for the present invention is disclosed in European Patent Application 0 586 924, published Mar. 16, 1994, which in its entirety is incorporated herein by reference. FIG. 1 illustrates an exemplary and highly suitable process 10 for producing a highly suitable nonwoven conjugate fiber web, more specifically a bicomponent fiber web. A pair of extruders 12*a* and 12*b* separately extrude two polymeric compositions, which compositions are separately fed into a first hopper 14*a* and a second hopper 14*b*, to simultaneously supply molten polymeric compositions to a spinneret 18 through conduits 16*a* and 16*b*. Suitable spinnerets for extruding conjugate fibers are well known in the art. Briefly, the spinneret 18 has a housing which contains a spin pack, and the spin pack contains a plurality of plates and dies. The plates have a pattern of openings arranged to create flow paths for directing the two polymers to the dies that have one or more rows of openings, which are designed in accordance with the desired configuration of the resulting conjugate fibers.

A curtain of fibers is produced from the rows of the die openings and is partially quenched by a quench air blower 20 before being fed into a fiber draw unit or an aspirator 22. The quenching process not only partially quenches the fibers but also develops a latent helical crimp in the fibers. Suitable fiber draw units or aspirators for use in melt spinning polymers are well known in the art, and particularly suitable fiber draw units for the present invention include linear fiber aspirators of the type disclosed in above-mentioned European Patent Application 0 586 924. Briefly, the fiber draw unit 22 includes an elongate vertical passage through which the filaments are drawn by heated aspirating air entering from the side of the passage from a temperature adjustable heater 24. The hot aspirating air draws the filaments and ambient air through the fiber draw unit 22. The temperature of the air supplied from the heater 24 is sufficient that, after some cooling due to mixing with cooler ambient air aspirated with the filaments, the air heats the filaments to a temperature required to activate the latent crimp. The temperature of the air from the heater can be varied to achieve different levels of crimp. In general, a higher air temperature produces a higher number of crimps.

The process line 10 further includes an endless foraminous forming surface 26 which is positioned below the fiber draw unit 22. The continuous fibers from the outlet of the draw unit are deposited onto the forming surface 26 in a random fashion to produce a continuous web of uniform density and thickness. The fiber depositing process can be assisted by a vacuum unit 30 placed below the forming surface 26. Optionally, the resulting web can be subjected to a light compacting pressure with a roller 32 to consolidate the web to impart additional physical integrity to the web before being subjected to a bonding process.

The nonwoven web is passed through, for example, a heated roll bonder 36. The web is brought to idler roll 38 and allowed to contact with the smooth surface of a heated roll 40 to heat the web. Thereafter, the heated web is passed through the pressure nip 42 formed by the smooth heated anvil roll 40 and a second heated embossing roll 44 which contains a plurality of raised points on its surface. The combination of the nip pressure and the heat from the heated rolls autogenously melt-fuse the fibers of the web at the raised points of the second heated embossing roll 44 when the web passes through the nip 42. The bonded web is passed through a tensioning idler roll 46 and allowed to be cooled. The temperature of the heated rolls 40 and 44 and the pressure of the nip 42 are selected so as to effect bonding without undesirable accompanying side effects such as excessive web shrinkage or fiber degradation. While particularly appropriate roll temperatures and nip pressures are generally influenced to an extent by such parameters as web speed, web basis weight, polymer properties and the like, the roll temperature is desirably lower than the melting temperature of the highest melting polymer of the web fibers and the nip pressure on the raised points of the heated roll can be between about 3,000 to about 180,000 psi. Alternatively suitable bonding processes include through-air bonding processes when the conjugate fibers contain component polymers that have different melting temperatures. In a through-air bonder, heated air, which is applied to penetrate the web, uniformly heats the web to a temperature above the melting point of the lowest melting component polymer and renders the component polymer adhesive. The melted polymer forms interfiber bonds, especially at cross-over points, throughout the web. In accordance with the present invention, through-air bonded nonwoven fabrics are highly desirable for the present invention in that the through-air bonding process uniformly effects strong interfiber bonds without compacting the web and, therefore, does not reduce the soft, cloth-like texture of the web during the bonding process.

The nonwoven layer may further contain minor amounts of other natural and synthetic fibers. For example, natural polymer fibers, such as rayon fibers, cotton fibers and pulp fibers, to impart natural fiber-like textures and hydrophilicity to the nonwoven layer.

Elastic layers suitable for the present invention can be produced from a wide variety of elastic materials. Useful materials for making the elastic layer include elastomers of styrenic block copolymers, thermoplastic polyurethanes, thermoplastic copolyesters, thermoplastic polyamides, isoprene and the like. The styrenic block copolymer elastomers include styrene/butadiene/styrene block copolymers, styrene/isoprene /styrene block copolymers, styrene/ethylene-propylene/styrene block copolymers and styrene/ethylene-butylene/styrene block copolymers, and suitable styrenic block copolymer elastomers are commercially available under the trademark Kraton® from Shell Chemical. The thermoplastic copolyester elastomers include polyetheresters having the general formula of:

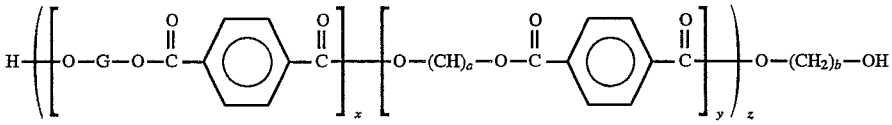

wherein "G" is selected from the group including poly (oxyethylene)-alpha,omega-diol, poly(oxypropylene)-alpha, omega-diol and poly(oxytetramethylene)-alpha, omega-diol; "a" and "b" are positive integers including 2, 4 and 6; and "x", "y" and "z" are positive integers including 1-20. Thermoplastic copolyester elastomers suitable for the present elastic layer are commercially available under the trademarks Arnitel® from Akzo, Inc. and Hytrel® from DuPont. The thermoplastic polyamide elastomers include polyamide-polyether block copolymers, e.g., those elastomers available under the trademark PEBAX® from the Rilsan Company, and the thermoplastic polyurethane elastomers include block copolymers containing various diisocyanates and polyesters or polyethers, e.g., those polyurethane elastomers available under the trademark ESTANE® from B. F. Goodrich & Co. Of these suitable elastomers, particularly suitable elastomers are styrenic block copolymers, which have low elastic tensile and modulus and high extensibilities, providing gentler and less constrictive elastic characteristics.

The compositions for the elastic layer may additionally contain processing aids known to be suitable for elastomeric polymers, such as lubricants and viscosity modifiers. For example, U.S. Pat. No. 4,663,220 to Wisneski et al. discloses a melt-extrudable elastomeric block copolymer composition modified with a viscosity modifying polymer, which patent is herein incorporated by reference.

Suitable elastic layers can be in the form of a film; nonwoven web, e.g., meltblown fiber web or spunbond fiber web; scrim; woven web; thin planar layout of strips or filaments; or the like. The elastomeric materials can be processed into an elastic nonwoven web of meltblown fibers or spunbond fibers using the above-described processes or can be melt-casted to form an elastomeric film using a conventional thermoplastic film casting process. Alternatively, the elastomeric materials can be spun into strands of elastomeric filaments. Such elastomeric filaments can be woven into a woven elastomeric fabric or arranged into a tow or layer of unbonded filaments. A tow of unbonded filaments can be directly bonded to a nonwoven fiber web layer in accordance with the present invention to form the elastic composite, thereby providing physical integrity to the elastic layer without bonding the elastic layer in a separate bonding step. Alternatively, strands of elastic filaments or elastic strips arranged in a planar spaced-apart fashion can be formed into an elastic layer by, for example, depositing meltblown fibers of a compatible polymer or an adhesive polymer to embed the strands in the meltblown fiber web, thereby providing a dimensionally stable elastic layer. The meltblown binder fibers can be elastic or nonelastic. However, if a nonelastic polymer is employed, the fibers need to be easily elongatable in order to take full advantage of the elasticity of the elastic strands.

The thickness of the elastic layer may be varied widely. However, it is desirable that the thickness of the elastic layer is equal to or less than about 35 mils if the layer is in a nonwoven form, is equal to or less than about 10 mils if the layer is in a film or strip form, and is equal to or less than 250 dtex if the layer is in a thread form in order to maintain a soft, flexible texture of the composite. Regardless of the selected physical configuration of the elastic layer, the layer should have sufficient elasticity to gather the nonwoven web layer for more than one stretch and recovery cycle and be attachable to the web. Although the required elasticity of the elastic layer depends on the physical properties of the nonwoven web layer, suitable elastic layers for the present invention have an elasticity in the range from about 50 grams to about 500 grams, more desirably from about 100 grams to about 300 grams, of tensile strength at 50% elongation as measured with a 1 inch by 6 inch rectangular strip of the layer material.

As stated above, the elastic layer is stretched and then bonded to the nonwoven layer at spaced-apart locations in a repeating pattern so that the nonwoven layer can be gathered between the bonded locations when the stretching tension is released. Alternatively, the nonwoven layer can be gathered and then bonded to a relaxed elastic layer. In accordance with the present invention, the total bonded area, i.e., the total area occupied by the bonded regions, that attaches the nonwoven layer to the elastic layer is between about 6% and about 20%, more desirably between about 7% and about 14%, of the total surface area of the composite. The elastic layer is bonded to the nonwoven web by any suitable bonding means including thermal bonding, ultrasonic bonding, adhesive bonding and hydroentangling processes. Generally described, a typical thermal or ultrasonic bonding process applies pressure while heating discrete locations on the overlaid elastic and nonwoven layers to melt fuse the two layers. For these melt-fusion bonding processes, it is important that the polymers of the two layers are at least partially compatible so that the polymers will fuse when melted under pressure. In general, it is the elastomeric material that melts and acts as binding agent to hold the different layers of the composite. Consequently, the combination of the temperature and pressure of the bonding apparatus applied on the composite needs to be sufficiently high enough to at least soften the elastomeric material. For example, when a styrene/ethylene-butylene/styrene block copolymer is employed as the elastic layer, the bonding points of the bonding apparatus should be at least about 65° C., which is the softening point of the block copolymer. However, the bonding points should not be overly heated so as to prevent the layers of the composite from sticking to the bonding rolls of the bonding apparatus.

The melt-fusion or bonding process of the nonwoven and elastic layers can be better facilitated by adding a tackifying agent into the polymer composition of the elastic layer. Any tackifying agent compatible with the elastic polymer and the polymer of the nonwoven web can be used, provided that the tackifying agent has sufficient thermal stability to withstand the processing temperature of the elastic layer forming process. Various tackifying agents are well known and are disclosed, for example, in U.S. Pat. No. 4,789,699 to Kieffer et al. and U.S. Pat. No. 3,783,072 to Korpman. Suitable tackifying agents include pressure sensitive adhesives, such as rosin, rosin derivatives, e.g., rosin esters, polyterpenes hydrocarbon resins and the like, and are commercially available. Suitable commercial hydrocarbon tackifying agents include Regalrez® from Hercules, Inc. and Arkon® P series tackifiers from Arkansas Co., N.J., and suitable commercial terpene hydrocarbon tackifying agents include Zonatac® 501 from Arizona Chemical Co. As an alternative method for bonding the nonwoven and elastic layers, when a sufficient amount of a pressure sensitive tackifying agent is added to the elastic layer composition, the two layers may be bonded merely applying pressure in the absence of heat.

Figure 2:
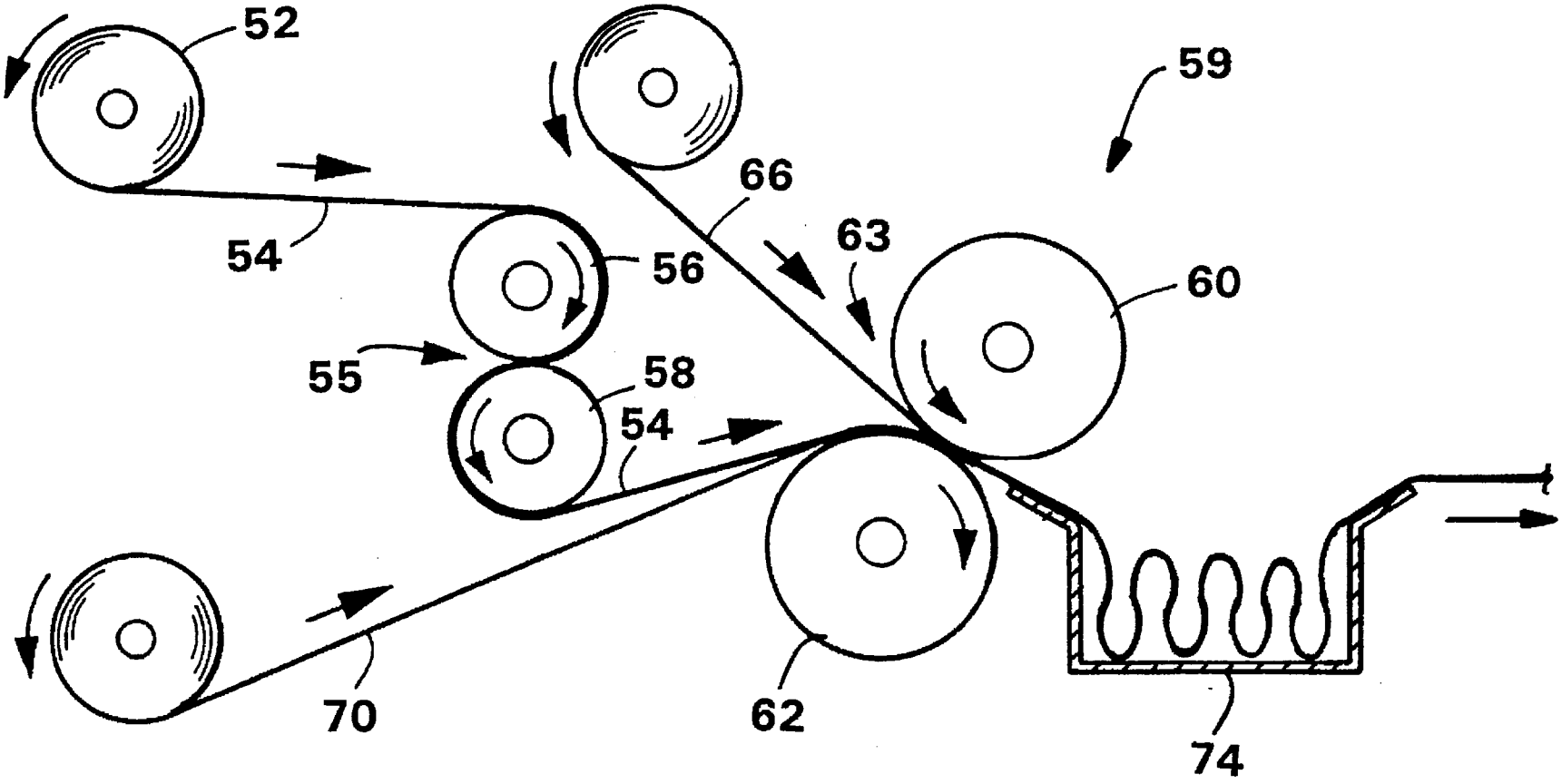
FIG. 2 illustrates a composite bonding process highly suitable for the present invention.

Turning to FIG. 2, there is illustrated a stretch bonding process suitable for the present invention. An elastic layer 54 is supplied from a supply roll 52 through the nip of a S-roll arrangement 55, having stacked rolls 56, 58 in the reverse-S path. From the S-roll arrangement 55, the elastic layer 54 is passed into the pressure nip 63 of a bonder roll arrangement 59, which contains a patterned calender roll 60 and a smooth anvil roll 62. A first nonwoven web 66 is placed on top of the elastic layer 54 and supplied to the bonder nip 63, and a second nonwoven web 70 is placed underneath the elastic layer 54 and fed to the bonder nip 63. The peripheral linear speed of the stack rolls 56, 58 of the S-roll arrangement 55 is controlled to be less than the peripheral linear speed of the bonding rolls 60, 62 so that the elastic layer 54 is stretched to a desired elongation level.

One or both of the patterned calender roll 60 and the smooth anvil roll 62 may be heated and the pressure between the smooth anvil roll 62 and the raised pattern of the patterned roll may be adjusted by well known means to provide the desired combination of heat and pressure to bond the elastic layer 54 to the nonwoven webs 66, 70. The intermittently bonded laminate emerging from the pressure nip of the bonding rolls 60, 62 is relaxed and allowed to cool in a holding box 74 for a sufficient length of time to avoid cooling the elastic layer 54 while it is in a stretched condition. The laminate is cooled in an untensioned condition since the material loses all or a considerable proportion of its ability to contract from the stretched dimensions when an elastic material is cooled in a stretched condition.

Similarly, the nonwoven layer and the elastic layer can also be bonded by intermittently applying an adhesive, e.g., hot melt-adhesive or pressure sensitive adhesive, on the tensioned elastic layer and then placing the nonwoven web over the elastic layer and curing or setting the adhesive to effect spaced-apart bond points. In order to provide improved cloth-like texture and hand, the adhesives can be applied in the form of a nonwoven web of fine denier fibers. As yet another alternative method of bonding the two layers, if the elastic layer contains intermittent voids therein, e.g., elastic nonwoven or scrim, the two layers can be bonded with a hydroentangling process, for example, disclosed in U.S. Pat. No. 3,494,821 to Evans.

In accordance with the present invention, the cohesion strength between the nonwoven and elastic layers is desirably between about 4 kg and about 10 kg. The cohesion strength is measured on a 2"×4" laminate test specimen which is attached to a slidably movable, flat aluminum platform with a 2"×2" double sided pressure sensitive tape, Scotch® #406, by applying a 60 lbs/in$^2$ force for 3 seconds. At the center of the affixed test specimen, a 1"×1"double sided pressure sensitive tape, Scotch® #406, is placed, and an aluminum block having a 1"×1" flat lower surface is placed over the tape and attached to the tape by applying a 60 lbs/in$^2$ force for 10 seconds. Then the attached block is secured and a downward pulling force is applied on the sample platform until the test specimen delaminates. The cohesion strength is the maximum force applied while delaminating the test specimen.

It has been found that the composite of the present invention containing polyolefin conjugate fibers exhibits natural fiber knit-like, more specifically, cotton knit-like, texture and hand while providing highly useful elastic properties. The composite also provides desirable levels of physical strength and abrasion resistance. In addition, the composite provides highly improved elastic properties in all planar directions of the composite, particularly in the directions that are substantially perpendicular to the stretch-relaxed direction. Consequently, the natural fiber knit-like composite is highly useful for elastic outer-covers and side-panels of various articles, such as training pants, diapers, incontinence products, environmental and hospital protective garments, and surgical drapes. An illustrative description of training pants is disclosed in U.S. Pat. No. 4,940,464 to Van Gompel et al. and an exemplary description of diapers is disclosed in U.S. Pat. No. 4,842,596 to Kielpikowski et al. Both of the patents are herein incorporated by reference.

The present invention is further described with the following examples. However, the examples are presented solely for purposes of illustration and should not be construed as limiting the invention.

EXAMPLES

The softness of the composite test specimens was mechanically characterized with the following two procedures.

Handle-O-Meter test: This test measures a characteristic termed "handle" or softness which is a combination of flexibility and surface friction. The Handle-O-Meter test was conducted in accordance with INDA Standard Test IST 90.0–75, except the test specimen size was 4 inch ×4 inch, using a Handle-O-Meter™ Model 211, available from Thwing-Albert Instrument Co.

Drape Stiffness: This test determines the bending length and flexural rigidity of a fabric by measuring the extent of bending of the fabric under its own weight. The Drape Stiffness test was conducted in accordance with ASTM Standard Test D-1388, except the test specimen size was 1 inch ×8 inch.

EXAMPLE 1

A 0.4 osy conjugate fiber web fabricated from highly crimped linear low density polyethylene and polypropylene bicomponent conjugate fibers having a round side-by-side configuration. The fibers had a 1:1 weight ratio of the two component polymers. The bicomponent fiber web was produced with the process illustrated in FIG. 1. The bicomponent spinning die had a 0.6 mm spinhole diameter and a 6:1 L/D ratio. Linear low density polyethylene (LLDPE), Aspun 6811A, which is available from Dow Chemical, was blended with 2 wt % of a $TiO_2$ concentrate containing 50 wt % of $TiO_2$ and 50 wt % of polypropylene, and the mixture was fed into a first single screw extruder. Polypropylene, PD3445, which is available from Exxon, was blended with 2 wt % of the above-described $TiO_2$ concentrate, and the mixture was fed into a second single screw extruder. The melt temperatures of the polymers fed into the spinning die were kept at 415° F., and the spinhole throughput rate was 0.5 gram/hole/minute. The bicomponent fibers exiting the spinning die were quenched by a flow of air having a flow rate of 45 SCFM/inch spinneret width and a temperature of 65° F. The quenching air was applied about 5 inches below the spinneret. The quenched fibers were drawn in the aspirating unit using a flow of air heated to about 350° F. and supplied to have a flow rate of about 51 $ft^3$/min/inch width. The resulting fibers had about 2.5 denier and about 5 crimps per extended inch as measured in accordance with ASTM D-3937-82. Then, the drawn fibers were deposited onto a foraminous forming surface with the assist of a vacuum flow to form an unbonded fiber web. The unbonded fiber web was bonded by passing the web through the nip formed by two abuttingly placed bonding rolls, a smooth anvil roll and a patterned embossing roll. The raised bond points of the embossing roll covered about 15% of the total surface area and there were about 310 regularly spaced bond points per square inch. Both of the rolls were heated to about 250° F. and the pressure applied on the webs was about 100 lbs/linear inch of width. The resulting bonded web had a thickness of 0.215 inches, and the web had a peak cup crush energy of about 48 g-mm and a peak cup load of about 3.4 g.

A meltblown elastic layer was prepared by meltblowing a blend of about 63 wt % Kraton G-1657, about 20% polyethylene Petrothane NA-601 (a viscosity modifier which is available from U.S.I. Chemical) and 17% Regalrez® 1126 utilizing recessed die tip meltblowing process equipment having a 0.09 inch recess and a 0.067 inch air gap. The equipment was operated under the following condition: die zone temperature about 540° F.; die melt temperature about 535° F.; barrel pressure 580 psig; die pressure 190 psig; polymer throughput 2 pounds per inch per hour; horizontal forming distance about 12 inches; vertical forming distance about 12 inches and winder speed about 19 feet per minute. The elastic layer had a basis weight of about 2 osy.

A stretch bonded composite having two outer nonwoven layers and one middle elastic layer was produced with the process illustrated in FIG. 2. The peripheral linear speed of the S-roll arrangement was about 135 feet per minute and the peripheral linear speed of the bonding rolls was kept at about 750 feet per minute, providing an elastic layer that is about 556% stretched. Two layers of the above-described nonwoven web were fed the nip of the bonding rolls to form a nonwoven/elastic/nonwoven composite. The bonding rolls were kept at about 110° F. and the pressure applied between the rolls was about 800 psi. The embossing roll of the bonding roll assembly had a bonding area of about 8% and a bond point density of about 52 bond points per square inch.

Control 1

An undergarment-type 100% cotton knit having a basis weight of about 6 osy, which is available from Balfour, a division of Kaiser Roth, was washed once in a residential washing machine with Ivory Snow detergent, which is available from Procter and Gamble.

Control 2

A bonded 0.4 osy polypropylene spunbond fiber web of 1.5 denier fibers produced from the above-indicated polypropylene was produced in accordance with the procedure outlined in Example 1, except a monocomponent fiber spinning die was used. The polypropylene fiber web had a peak cup crush energy of about 330 g-mm and a peak load of about 157 g. A composite was produced in accordance with Example 1 using the polypropylene web.

The composites of Example 1 and Control 2 and the cotton knit of Control 1 were tested for mechanically measured softness values. The results are shown in Table 1.

In addition, a tactile panel test was conducted on the three fabrics. The panel consisted of 12 members who were asked to place a numerical value for each attribute indicated in Table 2. The average of the numerical values assigned by the panel members for each attribute is indicated in Table 2.

TABLE 1

| | Handle-O-Meter | | Drape Stiffness (inches) | |
|---|---|---|---|---|
| Sample | CD | MD | CD | MD |
| Example 1 | 26.2 | 13.2 | 1.9 | 1.4 |
| Control 1 | 23.6 | 11.8 | 1.9 | 1.1 |
| Control 2 | >100 | 83.0 | 4.1 | 1.9 |

The comparison between the composites of Example 1 and Control 2 clearly demonstrates that the crimped conjugate fiber web of the present invention provides highly improved softness and flexibility. Furthermore, the composite of Example 1 has softness and flexibility values highly similar to Control 1, the cotton knit, indicating that the present composite has cotton knit-like physical properties.

TABLE 2

| | Scale | | | | |
|---|---|---|---|---|---|
| Attribute | 0 | ... | 15 | Ex1 | C1 | C2 |
| Thickness | Thick | | Thin | 3.7 | 3.3 | 6.1 |
| Fuzziness | Fuzzy | | Smooth | 6.7 | 5.7 | 3.3 |
| Grainy texture | Grainy | | Smooth | 2.5 | 2.7 | 8.6 |
| Lumpiness | Lumpy | | Even | 5.7 | 1.3 | 8.4 |
| Noise | Loud | | Quiet | 1.7 | 1.4 | 2.3 |
| Fullness | Full | | Not full | 7.3 | 8.2 | 10.7 |
| Warmth | Warm | | Cold | 6.7 | 6.0 | 9.6 |
| Stretchness | Stretch | | Rigid | 13.8 | 7.1 | 13.5 |

The tactile panel results demonstrate that the conjugate fiber web composite exhibits textural properties that closely emulate the textural properties of a cotton knit.

What is claimed is:

1. A multi-layer composite fabric comprising an elastic layer and a nonwoven web layer joined to said elastic layer at spaced-apart locations, said nonwoven web layer being gathered between the spaced-apart locations and wherein:

said nonwoven layer comprises crimped conjugate fibers having an average crimp level in the range of from about 3 to about 20 crimps per extended inch, as measured in accordance with ASTM D-3937 and which fibers comprise a first and a second polymeric component, said first component comprising a polymer selected from the group consisting of polyethylenes, polypropylenes, polybutylenes, polypentenes, polyvinyl acetates, and blends and copolymers thereof; and said nonwoven web layer has a cup crush energy equal to or less than 200 g-mm and a cup crush peak load equal to or less than 20 g.

2. The multi-layer composite of claim 1 wherein said second polymeric component comprises a polyolefin, wherein the polymers of said first and second components have different crystallization and shrinkage properties.

3. The multi-layer composite of claim 1 wherein said first component comprises polyethylene and said second component comprises polypropylene.

4. The multi-layer composite of claim 1 wherein said polyethylene is selected from the group consisting of high density polyethylene, linear low density polyethylene and blends thereof.

5. The multi-layer composite of claim 1 wherein said second polymeric component comprises a polymer selected from the group consisting of polyolefins, polyamides, polyesters, copolymers of ethylene and acrylic monomers, and blends and copolymers thereof.

6. The multi-layer composite of claim 1 wherein said nonwoven layer is a spunbond fiber web.

7. The multi-layer composite of claim 1 wherein said nonwoven layer is a staple fiber web.

8. The multi-layer composite of claim 1 wherein said conjugate fibers have an average weight per unit length of from about 1 denier to about 5 denier.

9. The multi-layer composite of claim 1 wherein said nonwoven layer has a basis weight between about 0.3 and about 1 ounce per square yard.

10. The multi-layer composite of claim 1 wherein said elastic layer comprises an elastic material selected from the group consisting of elastomers of styrenic block copolymers, thermoplastic polyurethanes, thermoplastic copolyesters, thermoplastic polyamides, isoprene and blends thereof.

11. The multi-layer composite of claim 1 wherein said elastic material layer is selected from the group consisting of films, nonwoven webs, scrims, woven webs, tows of filaments, and strands of filaments.

12. The multi-layer composite of claim 1 wherein said elastic layer is a meltblown nonwoven web.

13. The multi-layer composite of claim 1 wherein said nonwoven layer and said elastic layer are attached to have a total bond area between about 6% and about 20% of the total surface area of said composite.

14. A disposable article comprising the multi-layer composite of claim 1.

15. A training pants comprising the multi-layer composite of claim 1.

16. A protective garment comprising the multi-layer composite of claim 1.

17. A disposable diaper comprising the multi-layer composite of claim 1.

18. A natural fiber composite fabric comprising an elastic layer and a nonwoven layer joined to said elastic layer at spaced-apart locations, said nonwoven layer being gathered between the spaced apart locations and wherein:

said nonwoven layer comprises conjugate fibers having an average crimp level in the range of up to about 20 crimps per extended inch, as measured in accordance with ASTM D-3937 and which fibers comprise a first and a second polymer component, said first component comprising a polymer selected from the group consisting of polyethylenes, polypropylenes, polybutylenes, polypentenes, polyvinyl acetates, and blends and copolymers thereof;

said elastic layer comprises an elastic material selected from the group consisting of elastomers of styrenic block copolymers, thermoplastic polyurethanes, thermoplastic copolyesters, thermoplastic polyamides, isoprene and blends thereof; and said nonwoven web layer has a cup crush energy equal to or less than 200 g-mm and a cup crush peak load equal to or less than 20 g.

19. A natural fiber knit-like composite fabric comprising an elastic layer and a nonwoven layer joined to said elastic layer at spaced-apart locations, said nonwoven layer being gathered between the spaced-apart locations and wherein:

said nonwoven layer comprises crimped conjugate fibers having an average crimp level of up to about 20 crimps per extended inch as measured in accordance with ASTM D-3937, said fibers comprise a first and a second polymer component, said first component comprising a polymer selected from the group consisting of polyethylenes, polypropylenes, polybutylenes, polypentenes, polyvinyl acetates, and blends and copolymers thereof;

said elastic layer comprises an elastic material selected from the group consisting of elastomers of styrenic block copolymers, thermoplastic polyurethanes, thermoplastic copolyesters, thermoplastic polyamides, isoprene and blends thereof; and said nonwoven web layer has a cup crush energy equal to or less than 200 g-mm and a cup crush peak load equal to or less than 20 g.

* * * * *